US008104705B2

(12) United States Patent
Yu Chen

(10) Patent No.: US 8,104,705 B2
(45) **Date of Patent: *Jan. 31, 2012**

(54) FILM PACKING DEVICE

(76) Inventor: Hsiu-Man Yu Chen, Taichung County (TW)

( * ) Notice: Subject to any disclaimer, the term of this patent is extended or adjusted under 35 U.S.C. 154(b) by 289 days.

This patent is subject to a terminal disclaimer.

(21) Appl. No.: 12/607,163

(22) Filed: Oct. 28, 2009

(65) Prior Publication Data

US 2011/0095122 A1 Apr. 28, 2011

(51) Int. Cl.
*B65H 75/38* (2006.01)

(52) U.S. Cl. ..... 242/405.2; 242/405.3; 242/422.4; 242/588.2

(58) Field of Classification Search .... 242/405.2–405.3, 242/422.4, 594.2–594.6, 596, 596.2, 590, 242/588.2, 118.4, 118.41, 129.51; 53/591, 53/592

See application file for complete search history.

(56) References Cited

U.S. PATENT DOCUMENTS

| | | | | | |
|---|---|---|---|---|---|
| 4,179,081 | A * | 12/1979 | Parry | ..... | 242/422.1 |
| 4,530,473 | A * | 7/1985 | Parry | ..... | 242/588.2 |
| 5,947,409 | A * | 9/1999 | Corrigan, Jr. | ..... | 242/571.4 |
| 6,102,323 | A * | 8/2000 | Riemenschneider | ..... | 242/422.4 |
| 7,762,490 | B1 * | 7/2010 | Yu Chen | ..... | 242/405.2 |
| 2006/0032965 | A1 * | 2/2006 | Yu Chen | ..... | 242/422.4 |
| 2011/0233321 | A1 * | 9/2011 | Yu Chen | ..... | 242/588.2 |

* cited by examiner

*Primary Examiner* — Sang Kim
(74) *Attorney, Agent, or Firm* — Ming Chow; Sinorica, LLC

(57) ABSTRACT

A film packing device includes an axle tube having two opposing ends connected with a first handle and a second handle respectively. The axle tube is composed of a plurality of sleeves which are connected in series. Each sleeve has one end formed with a connecting block and an opposing end formed with a connecting trough for insertion of the connecting block of an adjacent one of the sleeves. The length of the axle tube of the film packing device is adjustable by adjusting the number of the sleeves to correspond to the width of a roll of film which doesn't have a reel therein for packing with ease.

8 Claims, 5 Drawing Sheets

FILM PACKING DEVICE

BACKGROUND OF THE INVENTION

1. Field of the Invention

The present invention relates to a film packing device for a roll of film which doesn't have a reel therein.

2. Description of the Prior Art

In order to avoid an article from falling during transportation, a roll of film is used to pack the article for providing a secure effect. In general, a film reel made of paper is used in the roll of film. The user stretches out his/her hands in two sides of the roll of film as a central axle for operating the roll of film. Alternatively, a rod is inserted through the roll of film as the central axle.

To consider environmental protection and cost, the roll of film is designed to be one without a reel. There is no support for the roll of film, causing the user unable to operate the roll of film with his/her hands direct. Although the rod is used in the roll of film, the rod is not adjustable. When using the film, the roll of film may be biased. This is unfavorable for packing. Sometimes, the roll of film is idle. Accordingly, the inventor of the present invention has devoted himself based on his many years of practical experiences to solve this problem.

SUMMARY OF THE INVENTION

The present invention is to provide a film packing device, which comprises an axle tube, a first handle, and a second handle. The axle tube is composed of a plurality of sleeves which are connected in series. Each sleeve includes a connecting block at one end and a connecting trough at an opposing end thereof. The connecting block has a first positioning portion thereon. The connecting trough has a second positioning portion therein. The second positioning portion corresponds to the first positioning portion. The connecting trough is adapted for insertion of the connecting block of an adjacent sleeve. The plurality of sleeves is connected in series to form the axle tube. One end of the axle tube is formed with the connecting block and the first positioning portion, and an opposing end of the axle tube is formed with the connecting trough and the second positioning portion. The first handle has one end formed with a coupling trough and a first engaging portion disposed in the coupling trough. The coupling trough corresponds to the connecting block of the axle tube. The first engaging portion corresponds to the first positioning portion. The coupling trough is adapted for insertion of the connecting block of the axle tube. The second handle has one end formed with a coupling block and a second engaging portion disposed on the coupling block. The coupling block corresponds to the connecting trough of the axle tube. The second engaging portion corresponds to the second positioning portion. The coupling block is adapted to connect with the connecting trough of the axle tube. The length of the axle tube of the film packing device is adjustable by adjusting the number of the sleeves to correspond to the width of a roll of film which doesn't have a reel therein for packing with ease, preventing the roll of film from being idle and biased during operation.

DETAILED DESCRIPTION OF THE PREFERRED EMBODIMENTS

Embodiments of the present invention will now be described, by way of example only, with reference to the accompanying drawings.

Figure 1:
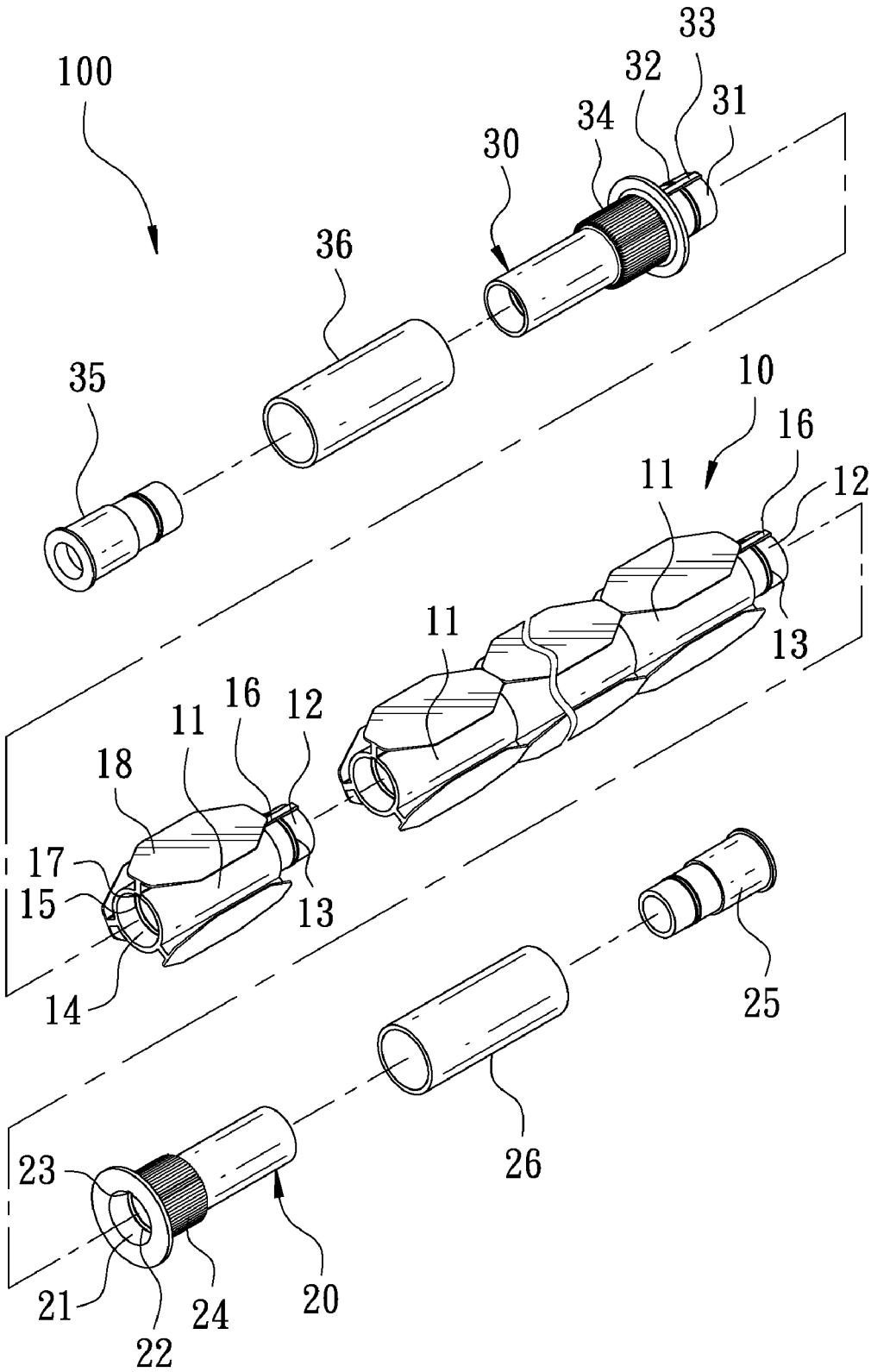
FIG. 1 is an exploded view according to a preferred embodiment of the present invention.
Figure 2:
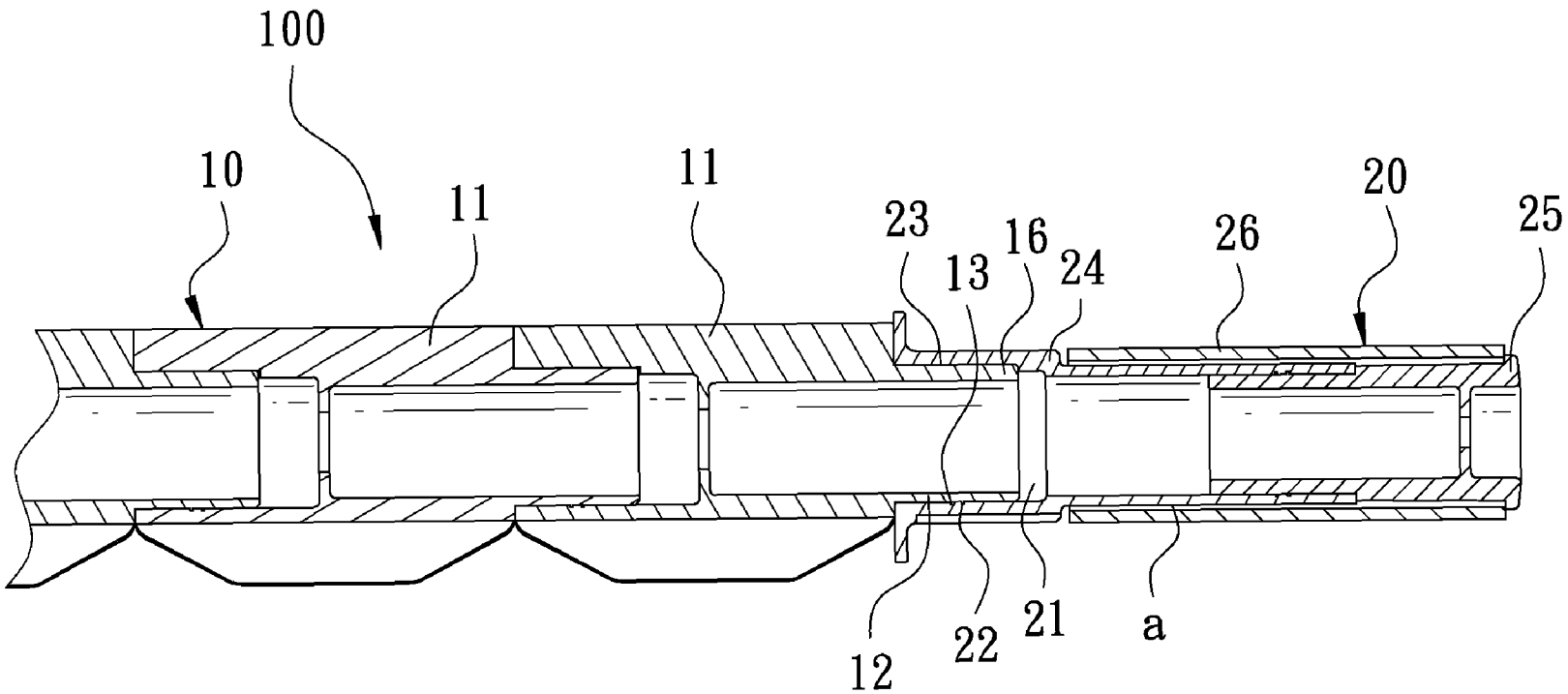
FIG. 2 is a partially cross-sectional view showing a first handle of the present invention.
Figure 3:
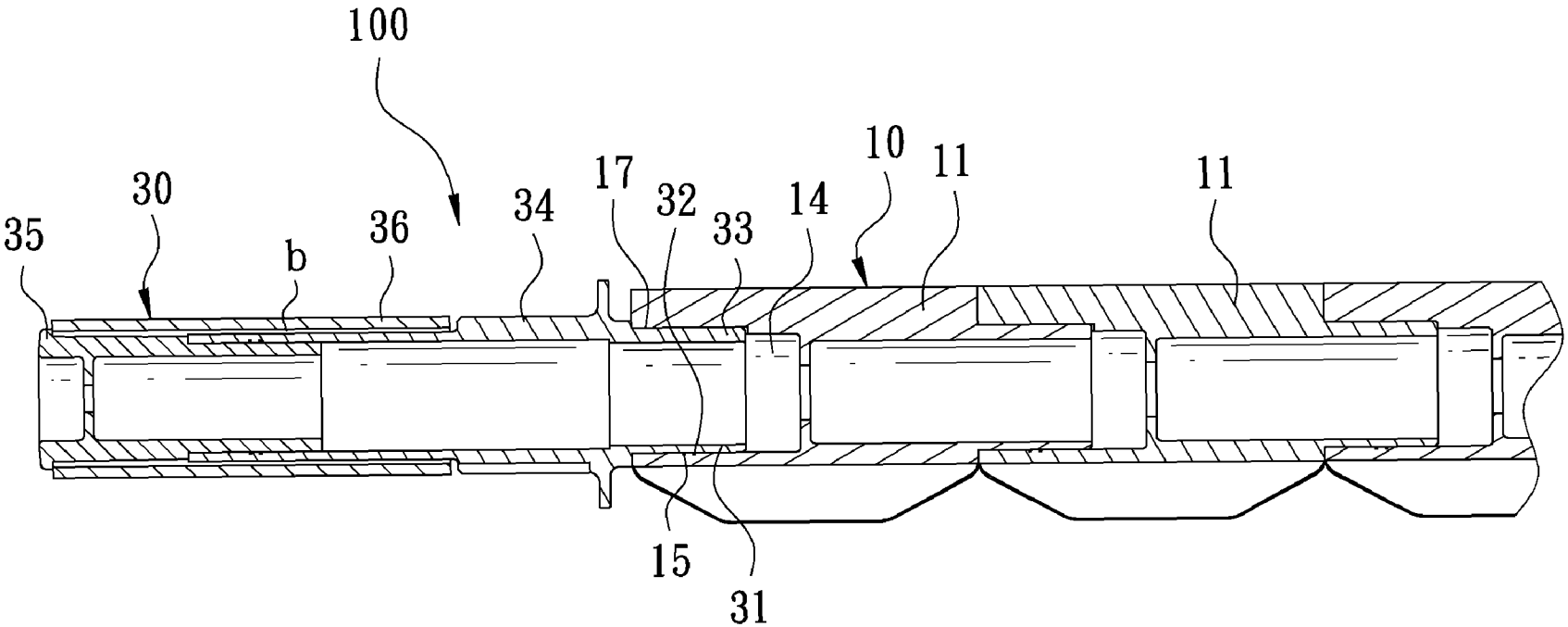
FIG. 3 is a partially cross-sectional view showing a second handle of the present invention.

As shown in FIGS. 1 to 3, a film packing device 100 according to a preferred embodiment of the present invention comprises an axle tube 10, a first handle 20, and a second handle 30.

Figure 4:
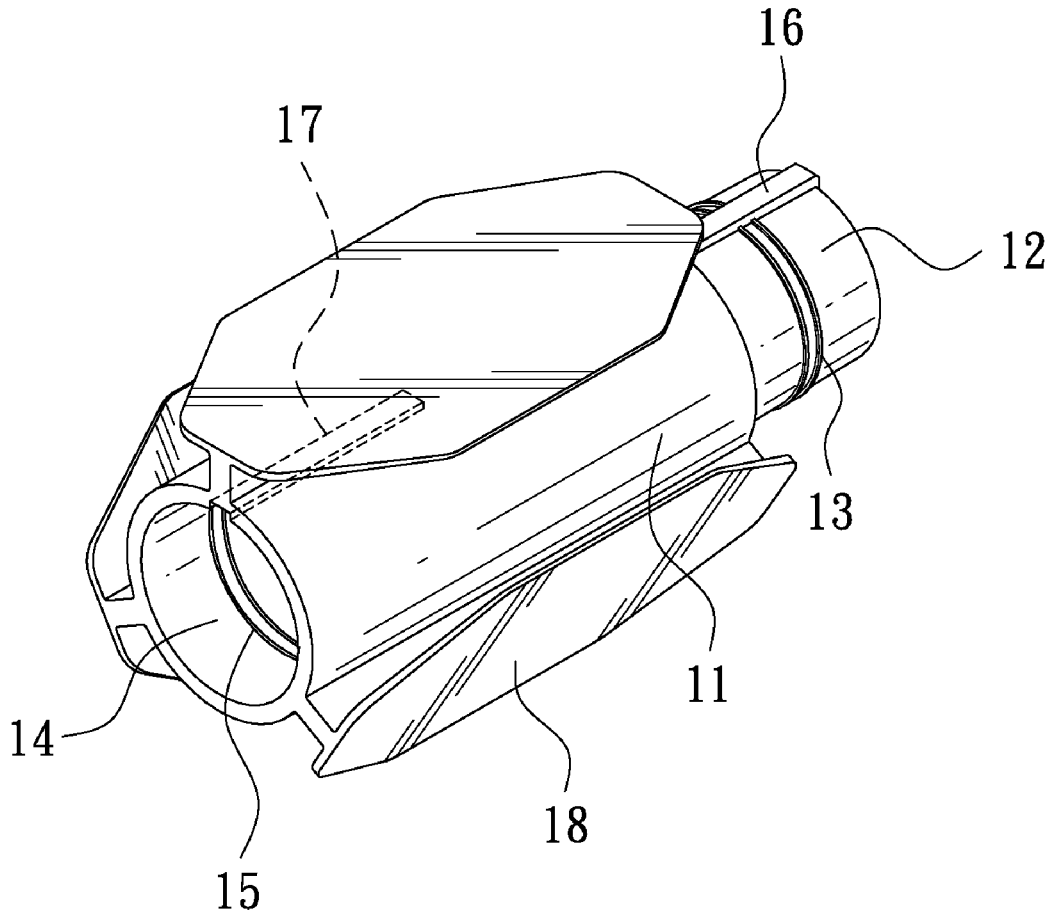
FIG. 4 is a perspective view showing a sleeve of the present invention.

The axle tube 10 is composed of multiple sleeves 11 which are connected in series. Referring to FIG. 4, each sleeve 11 includes a cylinder connecting block 12 at one end thereof and a connecting trough 14 at an opposing end thereof. The connecting block 12 has a first positioning portion 13 thereon. In this embodiment, the first positioning portion 13 is in the form of two annular protruding rings disposed on the connecting block 12. The connecting trough 14 has a second positioning portion 15 therein. The second positioning portion 15 corresponds to the first positioning portion 13 of the connecting block 12. In this embodiment, the second positioning portion 15 is in the form of two annular grooves disposed on an inner wall of the connecting trough 14. The connecting trough 14 is adapted for insertion of an adjacent connecting block 12. In addition, each sleeve 11 is axially formed with a positioning rib 16 on the connecting block 12. The inner wall of the connecting trough 14 is axially formed with a positioning groove 17 corresponding to the positioning rib 16. Each sleeve 11 further includes three tightening pieces 18 which are equally spaced and disposed on an outer wall of the sleeve 11. The sleeves 11 are connected in series to form the axle tube 10, as shown in FIG. 1. One end of the axle tube 10 is formed with the connecting block 12, the first positioning portion 13 and the positioning rib 16, while the other end of the axle tube 10 is formed with the connecting trough 14, the second positioning portion 15 and the positioning groove 17.

The first handle 20 has a first end and a second end opposite to the first end. The first end of the first handle 20 is formed with a coupling trough 21 and a first engaging portion 22 disposed in the coupling trough 21. The coupling trough 21 corresponds to the connecting block 12 of the axle tube 10. The first engaging portion 22 corresponds to the first positioning portion 13. In this embodiment, the first engaging portion 22 is in the form of two annular grooves disposed on an inner wall of the coupling trough 21. The inner wall of the coupling trough 21 is axially formed with a limit groove 23 corresponding to the positioning rib 16. The coupling trough 21 is adapted for insertion of the connecting block 12 of the axle tube 10. The first handle 20 is provided with a first brake ring 24 disposed close to the coupling trough 21. The second end of the first handle 20 is provided with a first stop member 25. A first handle sleeve 26 is provided between the first brake ring 24 and the first stop member 25. As shown in FIG. 2, a gap a is defined between the first handle sleeve 26 and the first handle 20 for providing a free rotation.

The second handle 30 has a first end and a second end opposite to the first end. The first end of the second handle 30 is formed with a coupling block 31 and a second engaging portion 32 disposed on the coupling block 31. The coupling block 31 corresponds to the connecting trough 14 of the axle tube 10. The second engaging portion 32 corresponds to the second positioning portion 15. In this embodiment, the second engaging portion 32 is in the form of two annular protruding rings disposed on the coupling block 31. The second handle 30 is axially formed with a limit rib 33 on the coupling block 31. The limit rib 33 corresponds to the positioning groove 17. The coupling block 31 is adapted to connect with the connecting trough 14 of the axle tube 10. The second handle 30 is provided with a second brake ring 34 disposed close to the coupling block 31. The second end of the second handle 30 is provided with a second stop member 35. A second handle sleeve 36 is provided between the second brake ring 34 and the second stop member 35. As shown in FIG. 3, a gap b is defined between the second handle sleeve 36 and the second handle 30 for providing a free rotation.

Figure 5:
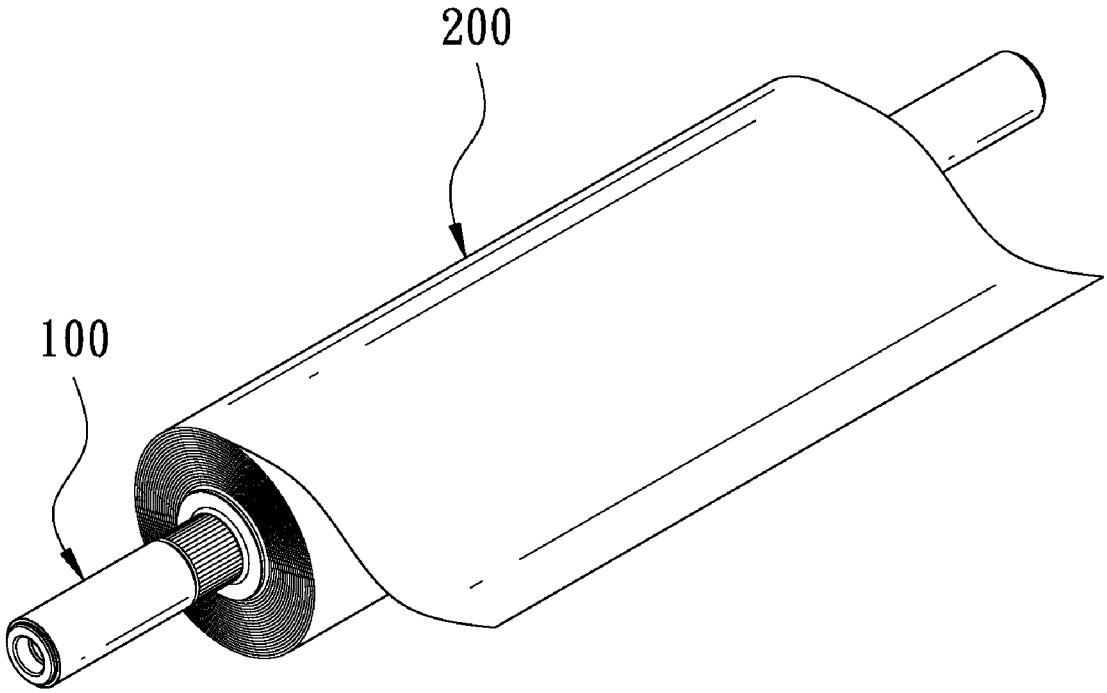
FIG. 5 is a schematic view of present invention when in use.

FIG. 5 is a schematic view showing the present invention when in use. When the user wants to use the film packing device 100, a roll of film 200 which doesn't have a reel therein is fitted on the axle tube 10 with the fastening pieces 18 to prop the roll of film 200 so that the roll of film 200 will not be idle when packing. The length of the axle tube 10 is adjustable by adjusting the number of the sleeves 11 to correspond to the width of the roll of film 200. The first handle 20 and the second handle 30 are connected with both ends of the axle tube 10, respectively, to complete the assembly of the present invention. Due to the gap a defined between the first handle 20 and the first handle sleeve 26 as well as the gap b defined between the second handle 30 and the second handle sleeve 36, the user holds the first handle sleeve 26 and the second handle sleeve 36 with his/her both hands and moves toward one side such that the axle tube 10 is turned to extend the roll of film 200 for packing. Because the length of the axle tube 10 is about equal to the width of the roll of film 200, the roll of film 200 will not be biased. When the user wants to stop the packing, he/she just moves both hands to grasp the first brake ring 24 and the second brake ring 34 to brake the first handle 20 and the second handle 30 respectively, such that the axle tube 10 stops rotating.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A film packing device, comprising:

an axle tube composed of a plurality of sleeves which are connected in series, each of the plurality of sleeves including at least one connecting block at one end thereof and a connecting trough at an opposing end thereof, the connecting block having a first positioning portion thereon, the connecting trough having a second positioning portion therein, the second positioning portion corresponding to the first positioning portion, the connecting trough being adapted for insertion of the connecting block of an adjacent one of the plurality of sleeves, the plurality of sleeves being connected in series to form the axle tube, one end of the axle tube being formed with the connecting block and the first positioning portion, an opposing end of the axle tube being formed with the connecting trough and the second positioning portion;

a first handle having one end formed with a coupling trough and a first engaging portion disposed in the coupling trough, the coupling trough corresponding to the connecting block of the axle tube, the first engaging portion corresponding to the first positioning portion, the coupling trough being adapted for insertion of the connecting block of the axle tube; and a second handle having one end formed with a coupling block and a second engaging portion disposed on the coupling block, the coupling block corresponding to the connecting trough of the axle tube, the second engaging portion corresponding to the second positioning portion, the coupling block being adapted to connect with the connecting trough of the axle tube.

2. The film packing device as claimed in claim 1, wherein the first positioning portion is in the form of two annular protruding rings disposed on the connecting block, and the second positioning portion is in the form of two annular grooves disposed on an inner wall of the connecting trough.

3. The film packing device as claimed in claim 1, wherein the first engaging portion is in the form of two annular grooves disposed on an inner wall of the coupling trough, and the second engaging portion is in the form of two annular protruding rings disposed on the coupling block.

4. The film packing device as claimed in claim 1, wherein each of the plurality of sleeves is axially formed with at least one positioning rib on the connecting block and the inner wall of the connecting trough is axially formed with a positioning groove corresponding to the positioning rib so that the connecting block of the axle tube is formed with the positioning rib and the connecting trough of the axle tube is formed with the positioning groove after the plurality of sleeves are connected with one another.

5. The film packing device as claimed in claim 4, wherein the inner wall of the coupling trough of the first handle is axially formed with a limit groove corresponding to the positioning rib of the axle tube, and the coupling block of the second handle is axially formed with a limit rib corresponding to the positioning groove of the axle tube.

6. The film packing device as claimed in claim 1, wherein the first handle is provided with a first brake ring disposed close to the coupling trough, a first stop member located at an opposing end with respect to the coupling trough, and a first handle sleeve located between the first brake ring and the first stop member, a gap being defined between the first handle sleeve and the first handle for providing a free rotation.

7. The film packing device as claimed in claim 1, wherein the second handle is provided with a second brake ring disposed close to the coupling block, a second stop member located at an opposing end with respect to the coupling block, and a second handle sleeve located between the second brake ring and the second stop member, a gap being defined between the second handle sleeve and the second handle for providing a free rotation.

8. The film packing device as claimed in claim 1, wherein each of the plurality of sleeves includes three tightening pieces which are equally spaced and disposed on an outer wall thereof.

* * * * *